US005264254A

United States Patent [19]

Bohnacker et al.

[11] Patent Number: 5,264,254

[45] Date of Patent: Nov. 23, 1993

[54] POWDER COATING METHOD FOR METALLIC SURFACES

[75] Inventors: Ulrich Bohnacker; Thomas Probst, both of Krauchenwies, Fed. Rep. of Germany

[73] Assignee: Tegometall Rudolf Bohnacker, Fed. Rep. of Germany

[21] Appl. No.: 763,467

[22] Filed: Sep. 23, 1991

[30] Foreign Application Priority Data

Sep. 21, 1990 [DE] Fed. Rep. of Germany ..... 4029985

[51] Int. Cl.[5] ..... B05D 1/06

[52] U.S. Cl. ..... 427/470; 427/486; 427/195; 427/202

[58] Field of Search ..... 427/27, 470, 486, 195, 427/202; 148/246

[56] References Cited

U.S. PATENT DOCUMENTS 2,809,906 10/1957 Baecker et al. ..... 148/246
4,746,533 5/1988 Hubbard ..... 427/27
4,944,813 7/1990 Hosemann et al. ..... 148/246 X

FOREIGN PATENT DOCUMENTS

3838928A1 5/1990 Fed. Rep. of Germany .
50-8402 4/1975 Japan .

*Primary Examiner*—Marianne Padgett
*Attorney, Agent, or Firm*—Foley & Lardner

[57] ABSTRACT

An electrostatical powder coating method starts out from a metallic surface provided with an oil film as a protection against corrosion during storing and transportation. Resin powder is applied to the surface without prior removal of the oil film. The powder layer is melted in a furnace and subsequently hardened by cooling. It is preferred that an amount of heat is supplied by the furnace which is sufficient to evaporate the oil. Preferably, an oil is used which is stable during heating as long as it remains on the work piece surface. This includes the possibility that all of the oil or at least some components thereof diffuse and evaporate through the powder layer during heating or, alternatively, that part or all of the oil remains on the work piece during the heat treatment and mixes with the powder layer. In both cases the quality of the resin coating is not deteriorated by the oil film.

20 Claims, No Drawings

POWDER COATING METHOD FOR METALLIC SURFACES

BACKGROUND OF THE INVENTION

The invention relates to a powder coating method for a metallic surface which has been provided with an oil film, wherein a powder layer is deposited on the surface, melted by heat treatment and subsequently hardened by cooling. Such a method is employed for coating metal parts as used in the automotive and other engineering industries, for casings of home appliances and other devices, for metal furniture and shelving, and for toys, for example.

Manufacturing these metal parts usually starts out from coiled band steel which has been oiled, painted or otherwise coated for protection against corrosion during transportation and storage ("coil coating"). The band steel is reeled off the coil and further worked such as by sawing, punching, pressing, drilling, folding and bending to obtain the desired product. During these processing steps, the oil or paint coating also serves as a lubricant and release agent between the tool and the workpiece (sheet or band metal).

When working from an oiled coil, the finished parts are painted or coated for protection against corrosion and for obtaining the desired colour. In wet painting, a paint containing a solvent is used. However, the evaporation of the solvent causes severe environmental problems.

These problems can be avoided by using an electrostatic powder coating method such as described in DE 3,838,928 Al. An electrostatically charged powder is sprayed onto the surface to which it adheres by electrostatic forces. Suitable powders are made of thermoplastic resins, e.g. polyester or epoxy resins or mixtures thereof. The powder layer is melted to form a viscous substance which adheres well to the metal and results in a smooth surface. The coating is hardened by cooling.

To obtain a high quality surface, cleaning of the metallic surface for removing the oil prior to the powder coating step has been considered absolutely necessary in the art. This cleaning step, however, requires the use detergents and solvents which again constitute environmental burdens, and further causes substantial costs. Costs are involved not only in the equipment required but also in the energy used to dry the metallic surfaces that have been wetted by the detergent or solvent. No high performance would be possible without drying.

These problems could be avoided by using pre-coated or painted coils instead of oiled ones. This technique, however, has severe disadvantages in that large storing area is required for making products in a variety of different colours. Further, changing the colour always requires a cumbersome change of coils at the production line. As another difficulty, colours of different coils are never identical, particularly with coils from different suppliers.

In addition, when using pre-coated or painted band or sheet steel, the edges of the metal parts subjected to sawing, punching or drilling are not coated and are therefore susceptible to corrosion. Further, since these parts have sharp edges their handling implies the danger of injury.

The above disadvantages can be avoided by using oiled coils and coating the parts after all mechanical working steps have been completed. Electrostatic powder coating is particularly suitable because the electric flux lines can be directed so that a particularly large amount of powder will adhere to the edges of the workpieces. Therefore, the resin coating formed on these areas after hardening is particularly thick and results in rounded edges. The main disadvantage of this method, however, resides in the costs and environmental problems which occur when the oil is removed, as described above.

SUMMARY OF THE INVENTION

It is an object of the invention to provide a powder coating method which incurs less environmental problems, which allows inexpensive mass production, in which the colour is easily reproduced and may be readily changed during manufacture, and in which the raw material is to a certain extent protected against corrosion.

This object is met by a powder coating method for a metallic surface provided with an oil film, wherein the powder is directly applied to the oil film disposed on the metallic surface, melted by heat treatment and subsequently hardened by cooling. The method of the invention thus starts out from an oiled metallic surface. The powder is directly applied to the oil film without removing it from the surface to be coated.

The invention allows the coating of metallic materials which have been provided with an oil or grease film for protection against corrosion and as a lubricant or release agent for mechanical working. Since it is not necessary to remove this oil or grease film, the method is inexpensive to use and environmentally beneficial.

The method of the invention is suitable for coating semifinished products, e.g. untreated metal bands, sheets or coils as well as parts which have been finished by mechanical working. The latter is preferred in cases where no uncoated edges are to remain for reasons of corrosion protection and in order to avoid any danger of injuries from sharp edges.

Further the method of the invention can be used for metal and steel any kind and shape including tubular and profiled parts.

DESCRIPTION OF PREFERRED EMBODIMENTS

It is advantageous to supply a sufficient amount of heat during the thermal treatment to cause the oil to diffuse through the powder layer and to evaporate. As a result, the oil will have no effect on the quality of the coated surface. When more oil is deposited and/or the oil used is less volatile, a larger amount of heat (temperature and time) is required during the thermal treatment. The evaporated oil suspended in the waste air of the furnace may be burnt and used for heating the furnace.

To obtain a high quality surface, it is desirable to use an oil which is stable during the heat treatment as long as it remains on the surface. This includes the possibility that all of the oil or some of its components diffuse through the powder layer and evaporate during heating or, alternatively, that part of all of the oil remains on the workpiece and is mixed with the powder. In case the oil deposited on the workpiece surface is not stable in the furnace and burns, the colour of the resin coating will be heavily affected by the oil and by transformations of the oil at elevated temperatures. Minute local variations in furnace temperature will result in a nonuniform surface structure and colour.

It is further advantageous to employ an oil which does not affect the colour during the heat treatment. In this case, unavoidable small changes in temperature and duration of the heat treatment will be harmeless.

The oil film is preferably formed so thin that the adherence of the electrostatically applied powder is not impaired. The powder will then remain nearly completely on the workpiece surface, and only little powder will come off the surface and fall on the floor of the coating box from where it may be collected and recycled for economy.

A coating with particular uniformity as to colour, thickness and structure may be obtained by making the surface density of the oil film smaller than about 3 g/m$^2$, preferably about 0.3 to 1.5 g/m$^2$, and the thickness of the resin coating at least ca. 50 μm, preferably ca. 50 μm to 80 μm. These values result in an excellent protection against corrosion during transport and storage of semi-finished material and ensure sufficient lubricating and releasing properties during mechanical working to reduce wear on the workpiece and tool.

Applying a phosphate containing layer prior to powder coating results in particularly effective anticorrosive properties and prevents rust from forming beneath the coating. In conventional powder coating methods, the oil film is removed by means of phosphatic and/or alkaline detergents. The phosphate film resulting therefrom forms an excellent anticorrosive which remains on the workpiece surface after drying. To utilise the anticorrosive properties of the phosphate film also in the present invention, an additional alkaline or phosphate containing film may be applied before, after or simultaneously with the oil, and in any case before the powder coating step.

An oil film which remains on the surface of the hardened coating constitutes an excellent lubricant film for further mechanical working. For that purpose a sufficiently large amount of oil has to be applied to the metallic surface and the heat in the furnace has to remain low enough to ensure that a certain amount of the oil remains on the workpiece.

DESCRIPTION OF EXPERIMENTS

The results of experiments that were carried out to determine the preferred embodiments of the inventive method are summarised in Tables 1 and 2. In the experiments, sample steel sheets (type "R" obtained from the German company Q-PANEL) were oiled, electrostatically powder coated and fed through a furnace. The coated sample sheets were microscopically inspected for their optical quality and subjected to a cupping test according to DIN ISO 1520 to determine the adhesive properties of the paint.

In all tests, a powder of a polyester-epoxy resin mixture was used. The powder was applied in such an amount that the thickness of the coating layer after hardening was approx. 70 to 80 μm.

Table 1 shows the results of the optical inspection of the hardened paint layer. The tests were conducted with different oils identified in the table by their trade name, supplier, oil base and viscosity at 40° C. The last five columns of Table 1 refer to different amounts of oil applied, and the results are given for surface densities from 0.5 to 2.5 g/m$^2$. Table 1 shows the symbol "x" if the respective oil resulted in the formation of visible oil islands or inclusions in the paint layer. In this case the painted surface appears "scarred". A faultless surface is marked with by the symbol "o".

Table 1 shows that a high optical quality of the coated sheet is achieved if the surface density of the oil does not exceed 2.0 g/m$^2$ and the viscosity of the oil at 40° C. is below 40 mm$^2$/s, e.g. if low-viscosity oil is used. An oil of low viscosity has the advantage that it may be applied very uniformly and that it easily diffuses through the powder layer and evaporates within the furnace. This is particularly true if the amount of oil applied is very low. At a surface density of 0.5 g/m$^2$ nearly any oil results in an optically perfect surface.

The optical quality of the surface is independent of whether an oil on the basis of mineral or plant oil such as rapeseed oil, is used.

Table 2 shows the results of the cupping test according to DIN ISO 1520 by which the adhesive properties of the paint layer were measured. In the cupping test, the sample sheet is deformed by a plunger, and the deformation depth at which the paint layer cracks is noted. For good adhesive properties of the paint, high deep-drawing indices are obtained.

In Table 2, different oils and their period of residence within the furnace are listed. The last five columns differ in the amount of oil applied, just as in Table 1. Table 2 gives the deformation (in mm) at which cracks occured (deep-drawing index). The furnace temperature was always 180° C. This temperature was reached by the sample sheets after a period of residence within the furnace of 14 min. The deep-drawing index was measured after residence periods of 14, 16 and 18 min. Conventional sample sheets from which all oil had been removed ("non-oiled" sampled sheets) were investigated as comparative examples.

Table 2 shows that when the amount of oil applied does not exceed a surface density of 1.5 g/m$^2$ and a sufficient period of residence within the furnace is maintained, the deep-drawing index is 5.0 mm or more, which indicates particularly good adhesive properties of the coating.

In the present case, a residence period of 18 min at a furnace temperature of 180° C. was sufficient. Under these conditions, the amount of heat supplied to the sample sheets is sufficient for the oil substantially to diffuse and evaporate through the powder layer.

At a surface density of the oil of 0.5 g/m$^2$, and with the above amount of heat applied, the deep-drawing index is of the same order as for non-oiled or "oil-removed" sheet metal, e.g. at about 10 mm. This value indicates exceptionally good adhesion.

TABLE 1

| | | Optical inspection of the painting | | | | | | |
|---|---|---|---|---|---|---|---|---|
| | | | Viscosity at 40° C. | Oil Surface Density (g/m$^2$) | | | | |
| Trading Name | Manufactor | Base Oil | (mm$^2$/S) | 0.5 | 1.0 | 1.5 | 2.0 | 2.5 |
| Anticorit RP 4107 | Fuchs | Mineral Oil | 27 | o | o | o | o | o |
| Anticorit RP 4107 S | Fuchs | Mineral Oil | 36 | o | o | o | o | x |
| Anticorit RP 4107 LV | Fuchs | Mineral Oil | 11 | o | o | o | o | x |
| Anticorit RP 4107 UF | Fuchs | Mineral Oil | unknown | o | o | o | o | o |
| Anticorit MZA 08 | Fuchs | Mineral Oil | 33 | o | o | o | o | x |

TABLE 1-continued

| Trading Name | Manufactor | Base Oil | Viscosity at 40° C. ($mm^2/S$) | Optical inspection of the painting: Oil Surface Density ($g/m^2$) 0.5 | 1.0 | 1.5 | 2.0 | 2.5 |
|---|---|---|---|---|---|---|---|---|
| Plantocorit N | Fuchs | Rape Seed Oil | 54 | x | x | x | x | x |
| Plantohyd 40 N | Fuchs | Rape Seed Oil | 40 | ○ | x | x | x | x |
| Plantocut 10 S | Fuchs | Rape Seed Oil | 8.8 | ○ | ○ | ○ | ○ | ○ |
| Ziehol 2079 | Esso | Mineral Oil | 80 | x | x | x | x | x |
| Plantohyd | Fuchs | Rape Seed Oil | 49 | ○ | x | x | x | x |

x = Formation of visible oil islands and inclusions
○ = Surface faultless

TABLE 2

Cupping test according to DIN ISO 1520: Adhesion of the paint layer in dependance of furnace temperature and sojourn time in the furnace.

| Trading Name | Base Oil | Viscosity ($mm^2/s$) at 40° C. | Temp. (°C.) | Time (min) | Deep-Drawing-Index (mm) at Oil Surface Density ($g/mm^2$) 0.5 | 1.0 | 1.5 | 2.5 | 2.5 |
|---|---|---|---|---|---|---|---|---|---|
| Anticorit RP 4107 | Mineral Oil | 27 | 180 | 18 | 9.8 | 7.2 | 5.2 | 4. | 2.5 |
| Anticorit RP 4107 | Mineral Oil | 27 | 180 | 16 | 1.9 | 2.9 | 1.5 | — | — |
| Anticorit RP 4107 | Mineral Oil | 27 | 180 | 14 | 0.9 | 0.8 | 0.5 | — | — |
| Anticorit RP 4107 LV | Mineral Oil | 11 | 180 | 18 | 11 | 8.2 | 6.6 | 6. | 3.0 |
| Anticorit RP 4107 LV | Mineral Oil | 11 | 180 | 16 | 3.0 | 2.2 | 3.6 | — | — |
| Anticorit RP 4107 LV | Mineral Oil | 11 | 180 | 14 | 0.5 | 0.5 | 0.5 | — | — |
| Plantohyd 40 N | Rape Seed Oil | 40 | 180 | 18 | 6.0 | 5.0 | 5.5 | 2.0 | 2.4 |
| Plantohyd 40 N | Rape Seed Oil | 40 | 180 | 16 | 3.4 | 1.0 | 1.1 | — | — |
| Plantohyd 40 N | Rape Seed Oil | 40 | 180 | 14 | 0.5 | 1.1 | 0.6 | — | — |
| No Oil | | | 180 | 18 | | | 10.5 | | |
| No Oil | | | 180 | 18 | | | 10.5 | | |
| No Oil | | | 180 | 16 | | | 6.8 | | |
| No Oil | | | 180 | 16 | | | 7.5 | | |
| No Oil | | | 180 | 14 | | | 0.6 | | |
| No Oil | | | 180 | 14 | | | 0.45 | | |

What is claimed is:

1. A method of powder coating a metallic surface which has been provided with an oil film comprising the steps of:

a) applying a layer of resin powder directly to said oil film, b) melting said resin powder by the application of heat, and c) hardening the melted resin powder by cooling.

2. The method of claim 1, wherein heat is applied during said step b) in such an amount that substantially all the oil forming said oil film diffuses and evaporates through the powder layer.

3. The method of claim 1, wherein the oil forming said oil film is stable during said step b) as long as it remains on said metallic surface.

4. The method of claim 1, wherein the oil forming said oil film is chemically sufficiently stable to prevent said layer of resin powder from discolouring during said step b).

5. The method of claim 1, wherein the oil film is made so thin that the adhesion of the layer comprising resin powder to the metallic surface is not affected.

6. The method of claim 1, wherein the surface density of said oil film is lower than about 3 $g/m^2$ and wherein the thickness of the resin layer obtained by said hardening is greater than about 40 μm

7. The method of claim 6, wherein the thickness of the resin layer is about 70 to 80 micrometers.

8. The method of claim 6, wherein the surface density of said oil film is 0.5 to 2 $g/m^2$.

9. The method of claim 1, wherein a phosphatic layer is applied to said metallic surface prior to said step a).

10. The method of claim 1, wherein oil is applied in such an amount that a residue of said oil forms a thin film on top of the hardened resin surface.

11. The method of claim 6, wherein said surface density is between about 0.3 and 1.5 $g/m^2$ and wherein said thickness of the resin layer is between about 50 to 80 micrometers.

12. The method of claim 1, wherein during the process at least some of the oil forming said oil film remains on the metallic surface and mixes with the powder layer.

13. The method of claim 12, wherein substantially all of the oil forming said oil film remains on the metallic surface during the process and mixes with the powder layer.

14. The method of claim 1, wherein said layer of resin powder is applied electrostatically.

15. The method of claim 1, wherein said metallic surface is steel.

16. The method of claim 1, wherein said resin powder comprises a polyester-epoxy mixture.

17. The method of claim 1, wherein the oil forming said oil film has a viscosity of less than 40 $mm^2/s$.

18. The method of claim 1, wherein the oil forming said oil film comprises mineral oil.

19. The method of claim 1, wherein the oil forming said oil film comprises rape seed oil.

20. A method of powder coating a metallic surface comprising the steps of:

a) providing said metallic surface with an oil film, b) applying a layer of resin powder directly to said oil film, c) melting said resin powder by the application of heat, and d) hardening the melted resin powder by cooling.

* * * * *